US005647403A

United States Patent [19]

Willbanks

[11] Patent Number: 5,647,403

[45] Date of Patent: Jul. 15, 1997

[54] JACQUARD LOOM LATCH CONTROL MECHANISM

[75] Inventor: Charles Everage Willbanks, Spartanburg, S.C.

[73] Assignee: Milliken Research Corporation, Spartanburg, S.C.

[21] Appl. No.: 416,068

[22] Filed: Apr. 4, 1995

[51] Int. Cl.[6] ..... D03C 3/20

[52] U.S. Cl. ..... 139/59; 139/455; 139/456

[58] Field of Search ..... 139/59, 455, 456

[56] References Cited

U.S. PATENT DOCUMENTS

| | | | |
|---|---|---|---|
| 3,265,096 | 8/1966 | Zangerle et al. . | |
| 3,586,061 | 6/1971 | Lauritsen . | |
| 3,828,826 | 8/1974 | Hurzeler . | |
| 4,195,671 | 4/1980 | Bossut . | |
| 4,572,247 | 2/1986 | Speich . | |
| 4,858,654 | 8/1989 | Derudder | 139/456 X |
| 5,095,952 | 3/1992 | Cheng | 139/455 X |
| 5,257,649 | 11/1993 | Froment . | |
| 5,392,820 | 2/1995 | Seiler | 139/455 |
| 5,464,046 | 11/1995 | McIntyre | 139/455 |

FOREIGN PATENT DOCUMENTS

| | | | |
|---|---|---|---|
| 477734 | 4/1992 | European Pat. Off. | 139/59 |
| 3705-738-A | 9/1983 | Germany . | |
| 291805340A | 1/1990 | Japan . | |
| 2-19534 | 1/1990 | Japan | 139/59 |

*Primary Examiner*—Andy Falik

*Attorney, Agent, or Firm*—Kevin M. Kercher; Terry T. Moyer

[57] ABSTRACT

A method and apparatus utilizing an elongate, flexible member operatively attached to rods that move up and down, on a Jacquard loom. A latch control mechanism is provided for latching said elongate, flexible member in a fixed position by applying pressure thereto by vacuum or pressure. This latching of the rod in an upper position creates a shed whereby filling yarns can be passed through to create Jacquard fabric. The pressure can be applied against the elongate, flexible member by filling sealed elongate, elastomeric member with pressured gas. In addition, the pressure can be applied against the elongate, flexible member by activating a dimensionally alterable, electric element that presses against the elongate, flexible member.

36 Claims, 8 Drawing Sheets

FIG. —1—

JACQUARD LOOM LATCH CONTROL MECHANISM

BACKGROUND OF THE INVENTION

Jacquard weaving is defined as a system of weaving that utilizes a highly versatile pattern mechanism to permit the production of large, intricate designs. This is accomplished by controlling the lifting of the warp yarns for the passage of the filling yarns. Each warp yarn is either raised or remains down forming what is technically referred to as a "shed". There is a means to control the rods that raise or lower the designated warp yarns that create the shed. Filling yarns are then passed through the shed to create the patterned Jacquard woven fabric.

A significant problem found with existing electronic Jacquard loom latches is that they are very complex and expensive. They typically have several moving parts and use relatively large amounts of electrical power. Examples include U.S. Pat. No. 4,195,671, issued to Bossut on Apr. 1, 1980, in which warp yarns are passed through guide eyes, these being mounted on the piston rods of fluid pressure operated piston and cylinder jacks. Another example is U.S. Pat. No. 3,586,061, issued to Lauritsen on Jun. 22, 1971, which discloses a servo-controlled selection mechanism operating on pressure variations, for selecting one or more of a number of displaceable operating members preferably in the form of pins or rods and intended primarily for magnetic operation. In addition, a further example is U.S. Pat. No. 3,265,096, issued to Zangerle, et al., on Aug. 9, 1966, which discloses a Jacquard machine with individual electromagnetically controlled heddles. This includes a magnet core and an armature constructed as a flat spring.

It is apparent that the above Jacquard loom latches are mechanically complex, thereby affording the opportunity for significant mechanical breakdown and quality problems. Another problem is the significant amount of power consumed by these systems.

The present invention solves these problems and others in a manner not disclosed in the prior art.

SUMMARY OF THE INVENTION

The present invention is directed to a method and apparatus utilizing an elongate, flexible member operatively attached to rods that move up and down, on a Jacquard loom. A latch control mechanism is provided for latching said elongate, flexible member in a fixed position by applying force thereto by means of a vacuum or pressure. This latching of the rod in an upper position creates a shed whereby filling yarns can be passed through to create Jacquard fabric. The force can be applied against the elongate, flexible member by filling sealed elongate, elastomeric member with pressured gas. In addition, the force can be applied against the elongate, flexible member by activating a dimensionally alterable, electric element that presses against the elongate, flexible member.

It is an advantage of this invention to provide an improved Jacquard loom latch control mechanism that is relatively simplistic to eliminate mechanical breakdowns.

Another advantage of this invention is to provide an inexpensive loom latch control mechanism.

Still another advantage of this invention is to provide an improved loom latch control mechanism that utilizes very little electrical power.

These and other advantages will be in part obvious and in part pointed out below.

BRIEF DESCRIPTION OF THE DRAWINGS

The above, as well as other objects of the invention, will become more apparent from the following detailed description of the preferred embodiments of the invention when taken together with the accompanying drawings, in which.

Corresponding reference characters indicate corresponding parts throughout the several views of the drawings.

DETAILED DESCRIPTION OF THE PREFERRED EMBODIMENT

Figure 1:
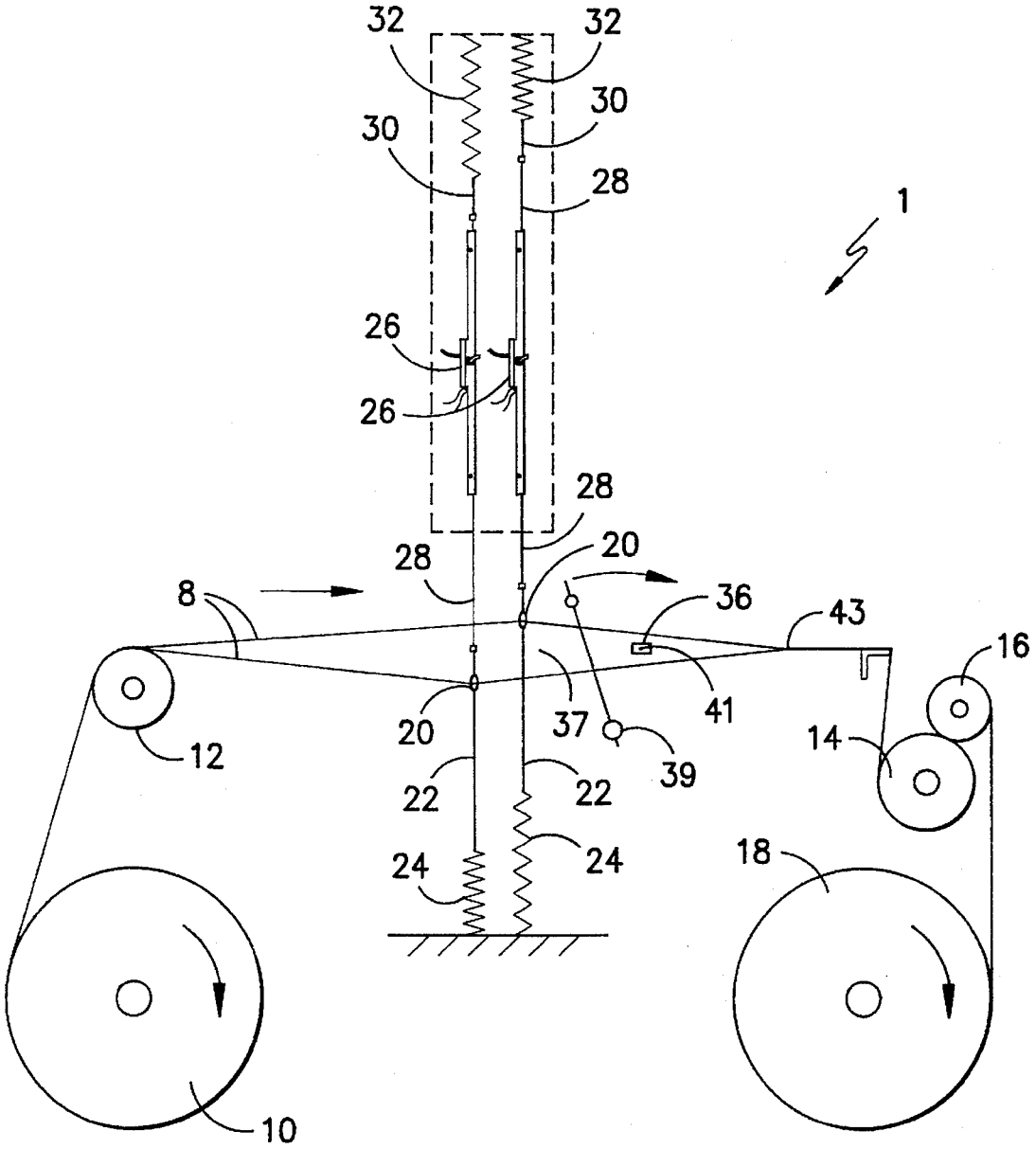
FIG. 1 is a diagrammatic view of the general construction of a loom having the Jacquard mechanism according to the present invention.

Referring now to the accompanying drawings, and initially to FIG. 1, the Jacquard loom is generally indicated by numeral 1 and includes a warp beam 10 onto which warp yarns 8 are wound and drawn off over a first guide and tension roll 12. The warp yarn 8 passes over a second guide and tension roll 14 and a third second guide and tension roll 16 and then onto a cloth beam 18 as finished Jacquard woven fabric. Each warp yarn 8 is drawn through a respective rod eye 20 which is provided on a lower rod 22 attached by a first spring 24 to a fixed part of the Jacquard loom. Weights may be substituted for springs. The other end of each lower rod 22 is attached to an elongate, flexible member 28 that can be held in a fixed position by means of latch mechanism of the present invention generally indicated by numeral 26. The other end of the elongate, flexible member 28 is attached to an upper rod 30 which is attached to a second spring 32 that also connects to another part of the Jacquard loom 1. A shed 37 is formed of raised and lowered warp yarns 8 in accordance with pattern data that determines which elongate, flexible members 28 are latched in an upper position or left in the lower position. A shuttle 36 carries the weft yarn 41 across the warp yarns 8 through the shed 37. After each traverse of weft yarn 41 through the shed 37, a reed 39 beats the weft yarn 41 against all of the adjacent weft warns or in other words against the fell 43.

A example of a typical Jacquard loom is that found in U.S. Pat. No. 3,828,826, issued Aug. 13, 1974, which is hereby incorporated by reference. In addition, another example of a Jacquard machine is disclosed in U.S. Pat. No. 3,265,096, issued Aug. 9, 1966, which is also hereby incorporated by reference.

Figure 2:
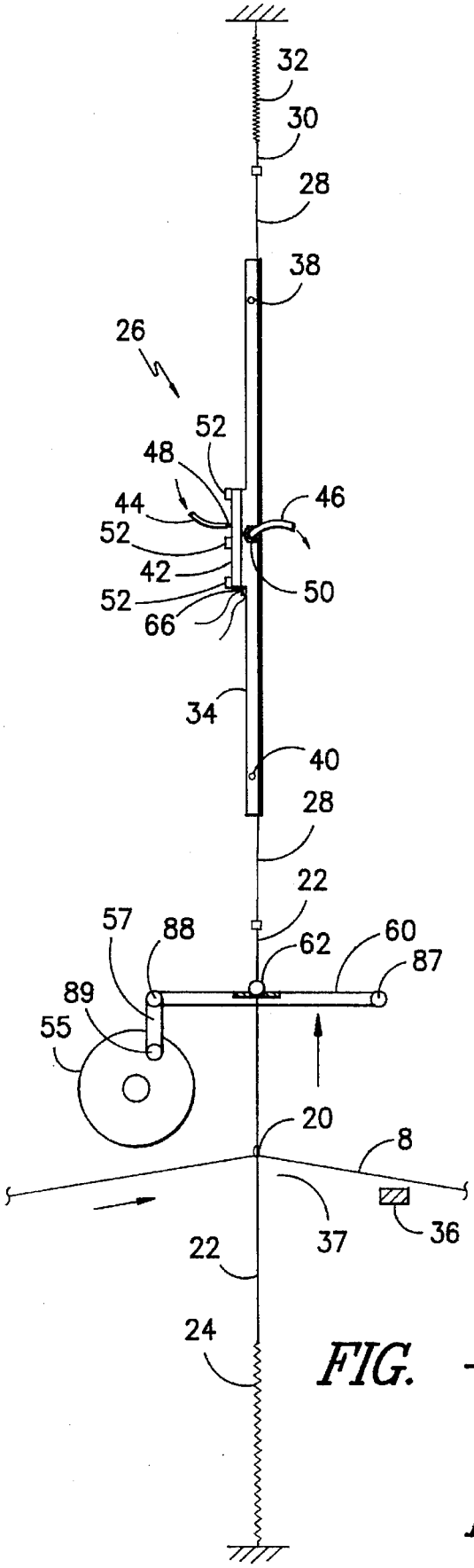
FIG. 2 is a side elevational view of the Jacquard loom latch control mechanism of the present invention lifting the rod in the upper position.
Figure 3:
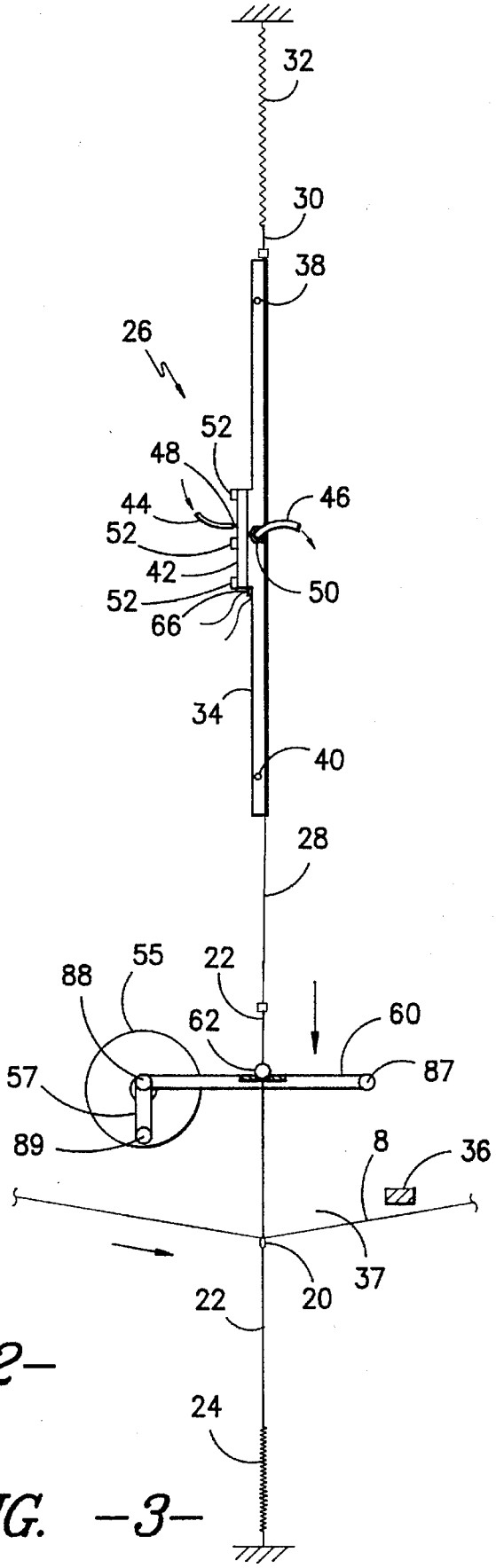
FIG. 3. is a side elevational view of the Jacquard loom latch control mechanism of the present invention with the rod in the lower position.
Figure 4:
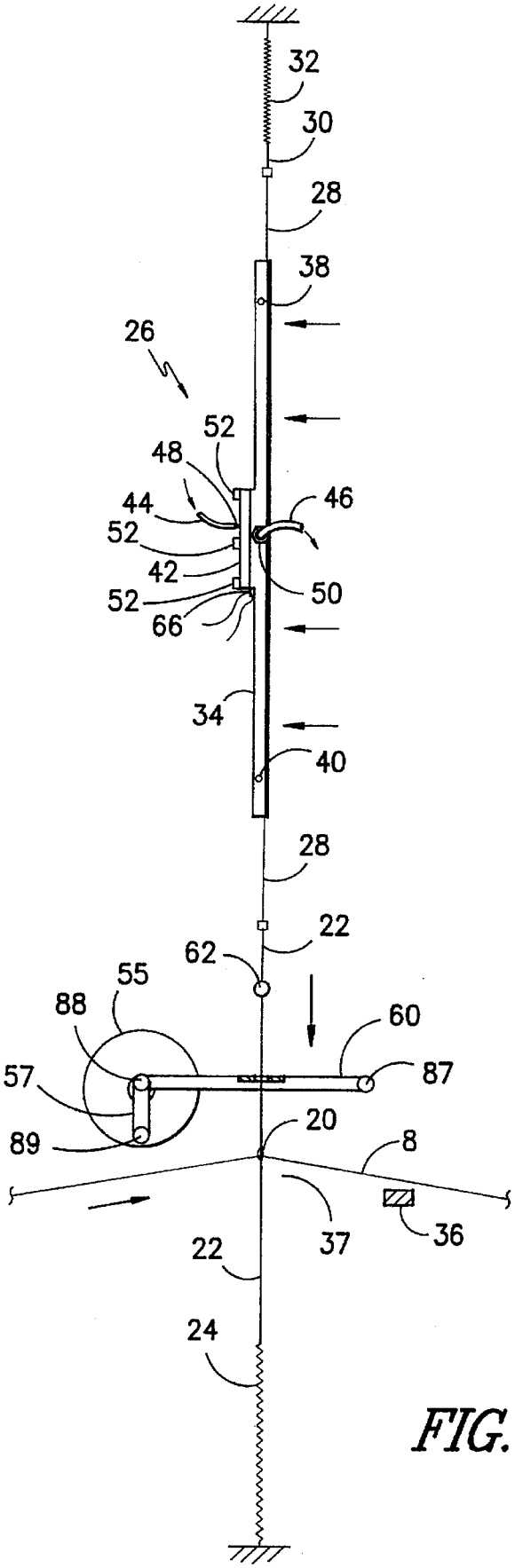
FIG. 4 is a side elevational view of the Jacquard loom latch control mechanism of the present invention wherein the latch control mechanism latches the rod in place.
Figure 5:
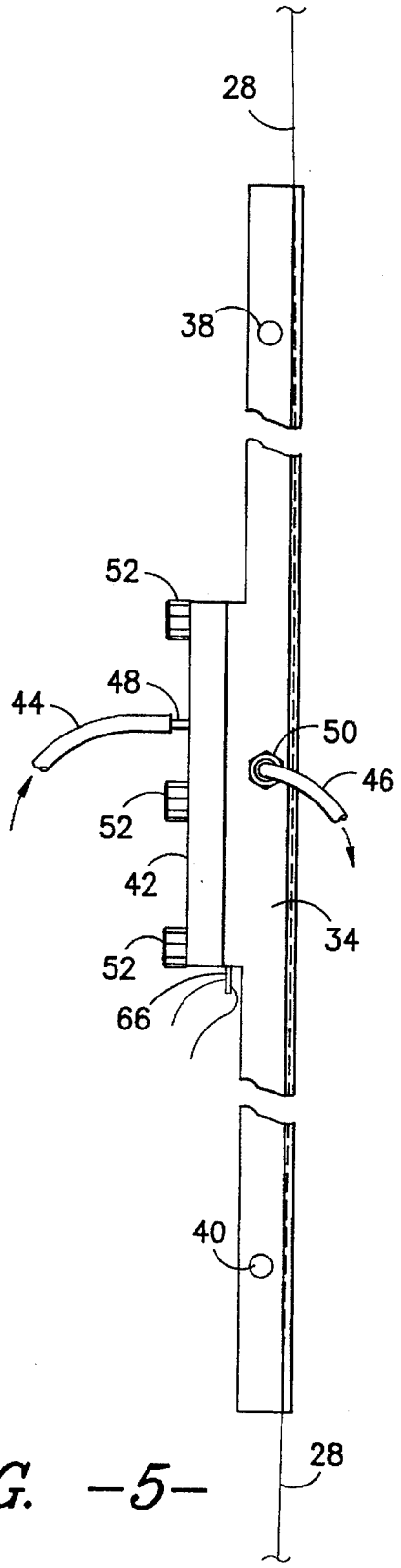
FIG. 5 is a side elevational view of the Jacquard loom latch control mechanism constructed according to the present invention.
Figure 6:
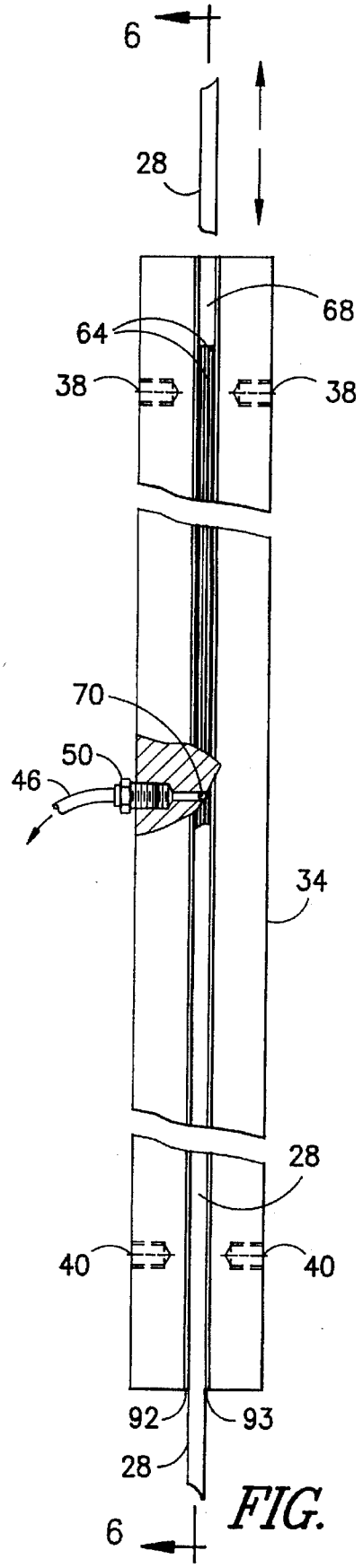
FIG. 6 is a rear elevational view of the Jacquard loom latch control mechanism of the present invention.

In order to change the shed 37, a crank 55 rotates and thus moves a reciprocating beam 60 up and down, as shown in FIGS. 2, 3, and 4. Reciprocating beam 60 is rotatably attached to a portion of a Jacquard loom 1 by means of first pivot pin 87. The other end of reciprocating beam 60 is rotatably attached to a connecting rod 57 by means of a second pivot pin 88. Reciprocating beam 60 is rotatably attached to a rotatable crank plate or disk 55 by means of a third pivot pin 89. Reciprocating beam 60 moves a force transfer element 62 up and down. Force transfer element 62 is attached to lower rod 22 which in turn is connected to the elongate, flexible member 28. This allows up and down movement of the rod eye 20 when the latch mechanism 26 is not holding the elongate, flexible member 28 in place. FIG. 2 reveals the reciprocating beam 60 holding the force transfer element 62 in an upper position and thereby the rod eye 20 so that the warp yarn 8 forming the shed 37 is in the upper position. FIG. 3 reveals the reciprocating beam 60 holding the force transfer element 62 in a lower position so that the rod eye 20 holding the warp yarn 8 forming the shed 37 is in the lower position. In contrast, FIG. 4 reveals the reciprocating beam 60 moving downward while the force transfer element 62 remains in the up position due to the activation of the latch mechanism 26. Accordingly, the rod eye 20 remains in the upper position so that the warp yarn 8 forming the shed 37 is in the upper position.

Figure 7:
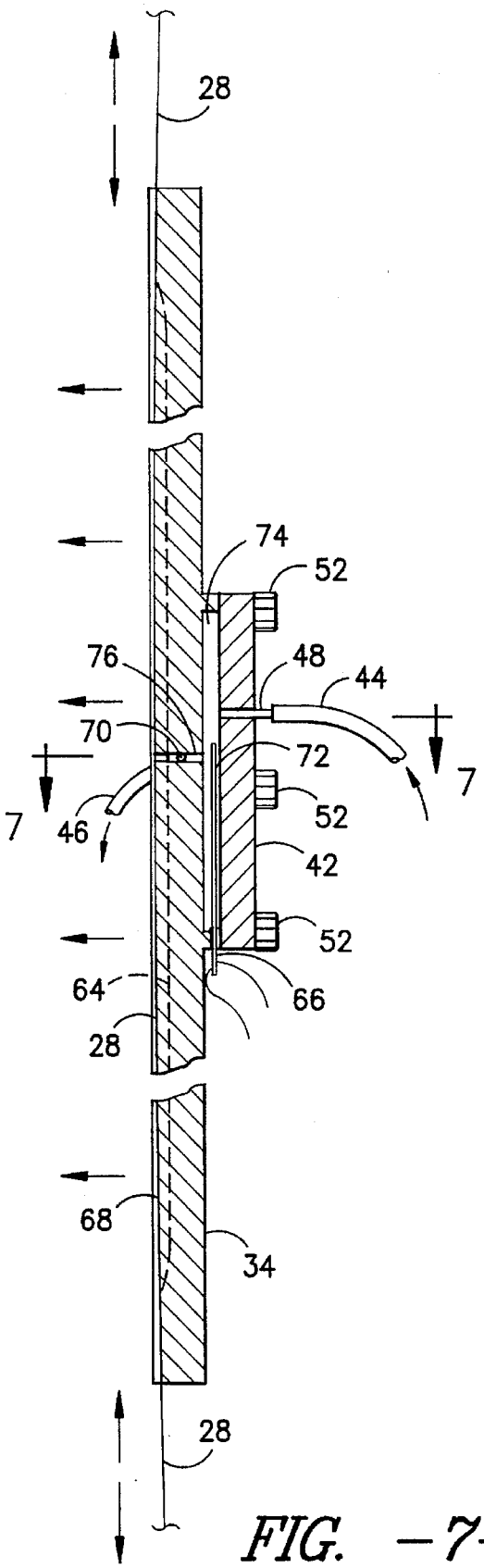
FIG. 7 is a cross-sectional view taken along Lines 6—6 of FIG. 6 whereby a piezo-electric element is deactivated.
Figure 8:
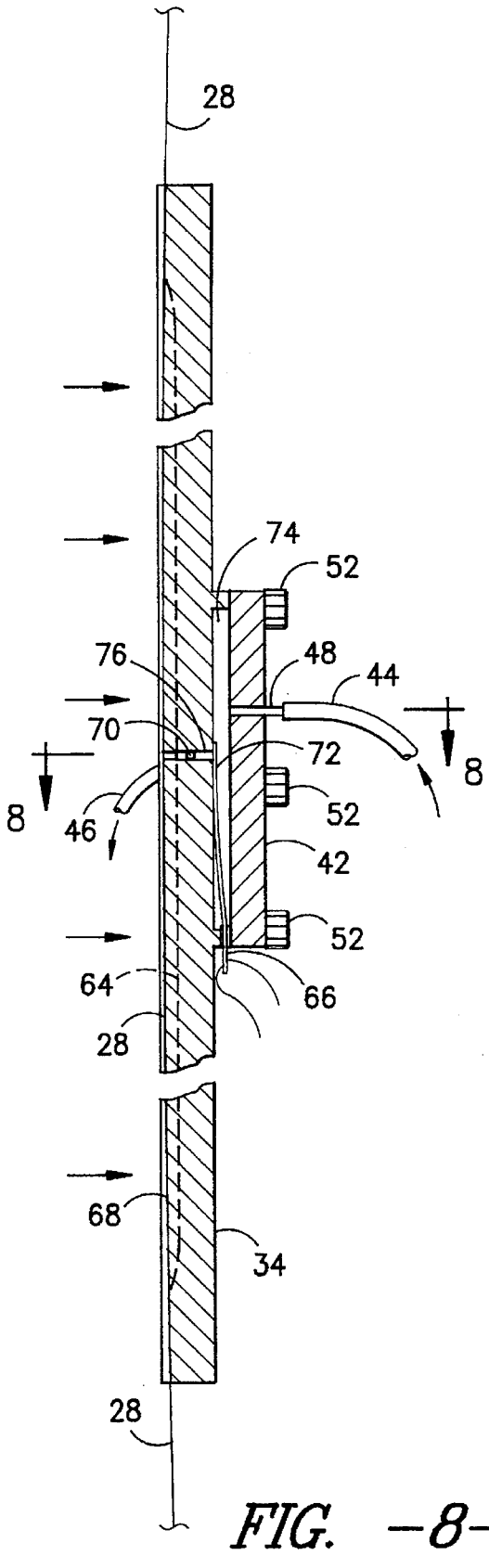
FIG. 8 is a cross-sectional view taken along Lines 6—6 of FIG. 6 whereby the piezo-electric element is activated.
Figure 9:
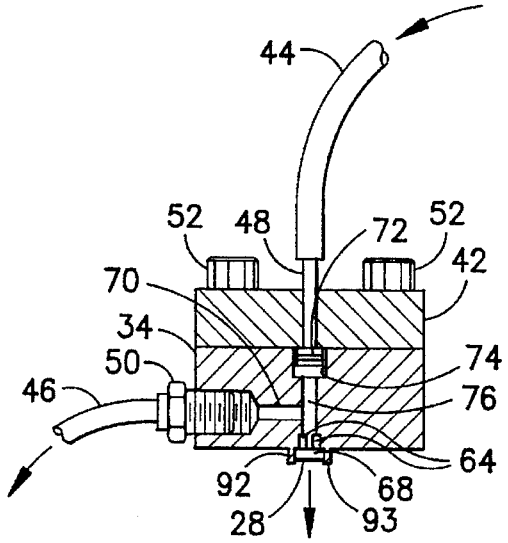
FIG. 9 is a cross-sectional view taken along Lines 7—7 of FIG. 7.

Referring now to FIGS. 2, 3, 4, 5, 6, 7, 8, 9, and 10, the elongate, flexible member 28 is preferably constructed out of MYLAR®, however, any of a wide variety of artificial or natural material will suffice such as but not limited to plastics, metals, composites, rubber, and so forth. This elongate, flexible member 28 is held in a curved channel 68 within a base member 34. Although a curved channel is preferred, any type of guide may be utilized such a series of pins, and so forth. This guide is defined to include the entire mechanism that directs the movement of the elongate, flexible member 28 and creates the fluid tight relationship therewith. There is a first flange member 92 and a second flange member 93 to hold the elongate, flexible member 28 within the base member 34. Base member 34 includes a top pair of tapped holes 38 and a bottom pair of tapped holes 40 for attachment to a Jacquard loom 1. There is a cover plate 42 attached to the base member 34 by means of a series of three pairs of attachment bolts 52. Located between cover plate 42 and base member 34 is a piezo-electric element 66, as shown in FIGS. 7 and 8. Piezo-electric element 66 has a bimorph 72 that moves back and forth within a deflection chamber 74. This deflection chamber 74 is formed between the base member 34 and the cover plate 42. As shown in FIGS. 2, 3, 4, 5, and 6, when the piezo-electric element 66 is not activated, pressurized air enters a first rubber tube 44 with positive pressure and into a capillary tube 48 that allows the air to flow into the deflection chamber 74. The capillary tube 48 is secured within cover plate 42 and allows the pressurized gas to pass therethrough. Pressurized gas is not required and there can merely be an opening to the atmosphere. However, this opening to the atmosphere is much less effective. The pressurized gas then passes through a vacuum conduit 76 and into a fitting vacuum slot 70 and out through a fitting adapter 50 which is connected to a second rubber tube 46. Second rubber tube 46 is under a negative pressure or vacuum. Therefore, when the bimorph 72 of the piezo-electric element 66 is in a deactivated condition, pressurized gas passes into the first rubber tube 44 into capillary tube 48 and then into deflection chamber 74. The pressurized gas then goes into the vacuum conduit 76 and out to the fitting vacuum slot 70 that is a part of the fitting adapter 50 that is connected to a second rubber tube 46. The bimorph 72 in a deactivated condition is shown in FIGS. 7 and 9. In this mode, the pressure difference across the elongate, flexible member is near zero and the normal force and accompanying friction force is low. The deactivated condition allows the elongate, flexible member 28 to move back and forth in the curved channel 68 of the base member 34.

Figure 10:
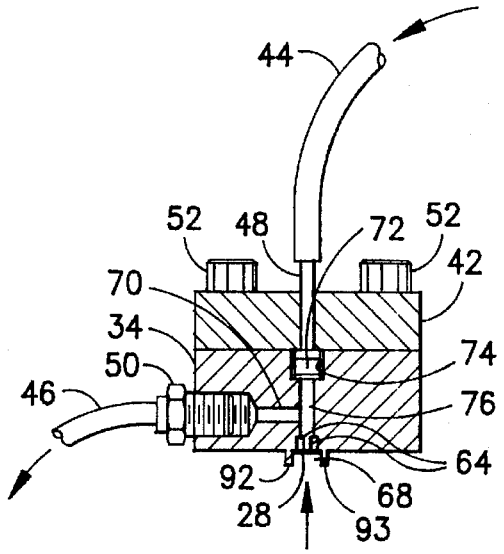
FIG. 10 is a cross-sectional view taken along Lines 8—8 of FIG. 8.

As shown in FIGS. 8 and 10, when the bimorph 72 is activated, a vacuum is created since the pressurized air from the first rubber tube 44 is not allowed into the vacuum conduit 76. The vacuum from second rubber tube 46 into fitting adapter 50 of vacuum slot 70 creates a suction at a pair of grooves 64 thereby holding or latching the elongate, flexible member 28 in the curved channel 68 of the base member 34. The elongate, flexible member 28 is pulled back against the grooves 64 by the vacuum created in vacuum conduit 76 through vacuum slot 70 and fitting adapter 50 and second rubber tube 46, thereby latching the elongate, flexible member 28 in a fixed position, thereby presenting a stark contrast to the deactivated condition.

Figure 11:
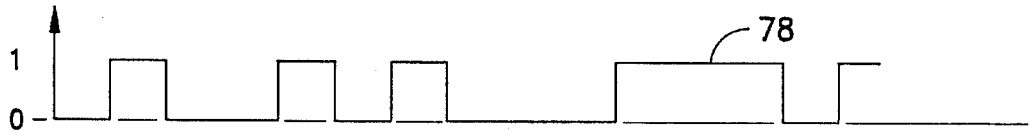
FIG. 11 is a graphical representation of an input data voltage signal.
Figure 12:
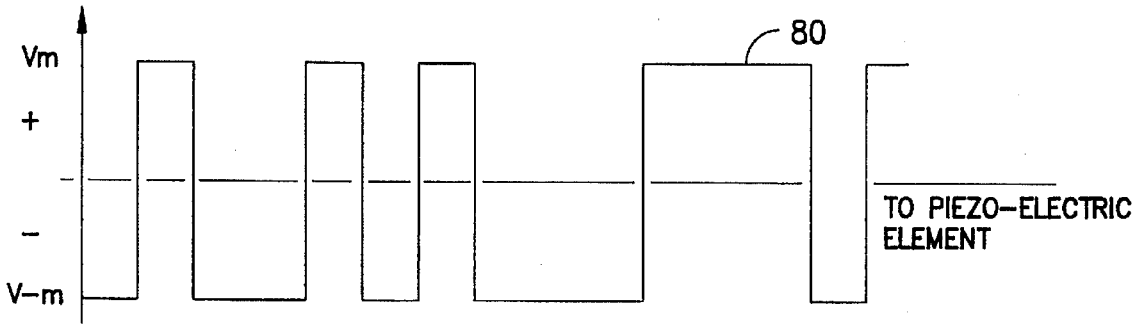
FIG. 12 is a graphical representation of an output data voltage signal that is transmitted to a piezo-electric element.

As shown in FIG. 11, piezo-electric element 66 is activated by a digital input data signal 78. However, this digital input data signal 78 must be amplified by means of a signal conditioner to provide the proper voltage to move the bimorph 72. As shown in FIG. 12, this output data signal is referenced by numeral 80.

Figure 13:
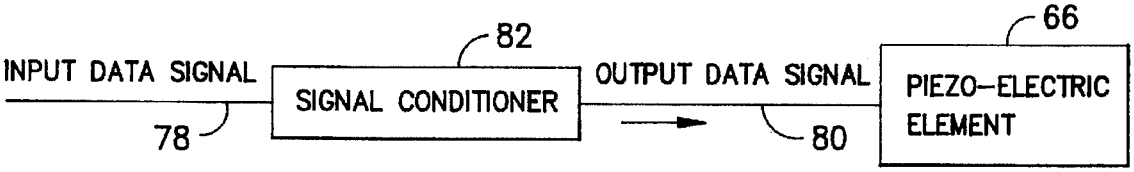
FIG. 13 is a schematic diagram whereby an input voltage data signal is transformed by means of a signal conditioner into an output voltage data signal that activates a piezo-electric element.

FIG. 13 discloses the digital data input signal 78 going through a signal conditioner 82 resulting in the output data signal 80 that electrically activates the piezo-electric element 66. A typical non-limiting example of a piezo-electric element 66 is a bimorph manufactured by Piezo Systems, Inc., located at 186 Massachusetts Avenue, Cambridge Mass. 02139.

Figure 14:
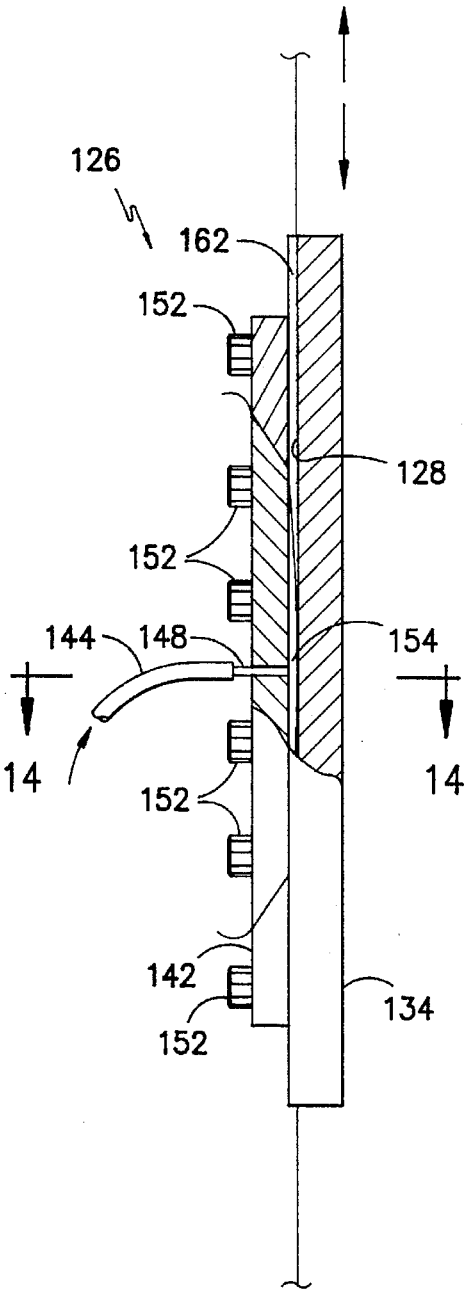
FIG. 14 is a Jacquard loom latch control mechanism of a first alternative embodiment whereby the elastomeric member creates a frictional latch to frictionally hold the elongate, flexible member in position.
Figure 15:
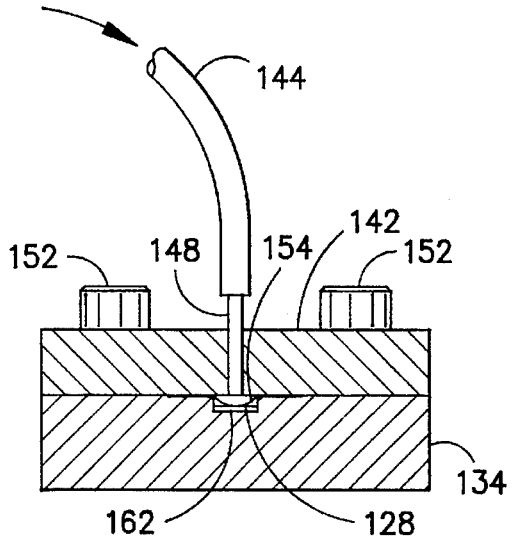
FIG. 15 is a cross-sectional view taken on Line 14—14 of FIG. 14 whereby elastomeric member is inflated to latch a elongate, flexible member in position.
Figure 16:
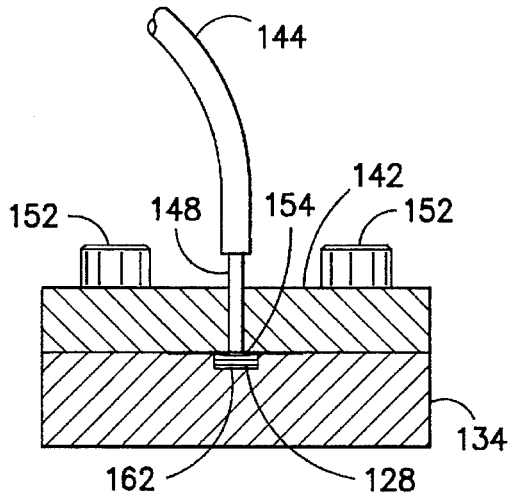
FIG. 16 is a cross-sectional view taken on Line 14—14 of FIG. 14 whereby a sealed elastomeric, elongate member is not inflated thereby allowing the elongate, flexible member to move freely.

Referring now to FIGS. 14, 15, and 16, a first alternative embodiment 126 utilizing a base member 134 having a guide in the form of a rectangular notch 162 located therein for passage of a elongate, flexible member 128. This elongate, flexible member 128 is identical to elongate, flexible member 28, as previously described. There is a cover plate 142 attached to the base member 134. An example of this attachment would include a series of six pairs of bolts 152 passing through said cover plate 142 and threadedly attached to the base member 134. Pressurized gas enters a rubber tube 144 through capillary tube 148 and into a sealed elastomeric, elongate member 154. The capillary tube 148 extends through cover plate 142 and into a rectangular notch 162. The sealed elastomeric, elongate member 154 extends the entire length of the rectangular notch 162 and is sealed in relation to capillary tube 148.

As shown in FIG. 15, when the pressurized gas enters rubber tube 144 and then flows into capillary tube 148, it fills sealed elastomeric, elongate member 154, thereby holding or latching the elongate, flexible member 128 in a fixed position. As previously described, this allows the reciprocating beam 60 holding the force transfer element 62 in an upper position and thereby the rod eye 20 so that the warp yarn 8 forming the shed 37 is in the upper position, as shown in FIG. 1. As shown in FIG. 16, when there no air or pressurized gas being applied to rubber tube 144, then the sealed elastomeric, elongate member 154 does not inflate thereby allowing the elongate, flexible member 128 to move back and forth unhindered. As previously described, this allows up and down movement of the rod eye 20 when the latch mechanism 126 is not holding the elongate, flexible member 128 in place, as shown in FIG. 1.

Figure 17:
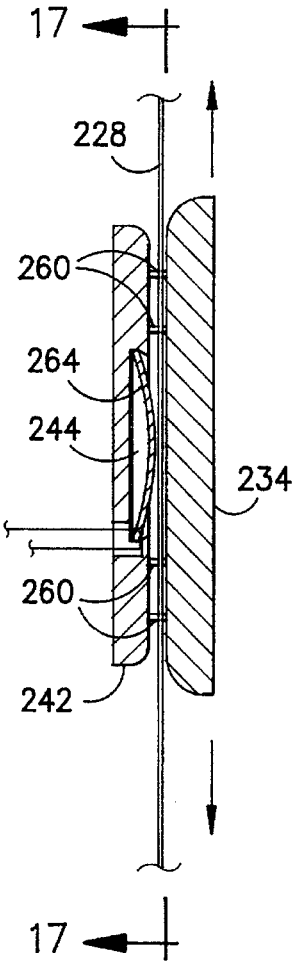
FIG. 17 is a side elevational view of an alternative embodiment of the Jacquard loom latch control mechanism of the present invention whereby a circular piezo-electric disk is deactivated thereby allowing the elongate, flexible member to move freely up and down.
Figure 18:
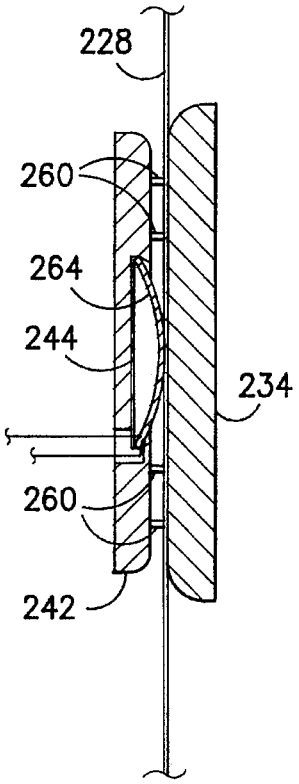
FIG. 18 is a side elevational view of a second alternative embodiment of the Jacquard loom latch control mechanism of the present invention whereby a circular piezo-electric disk is activated thereby frictionally holding the elongate, flexible member in position.
Figure 19:
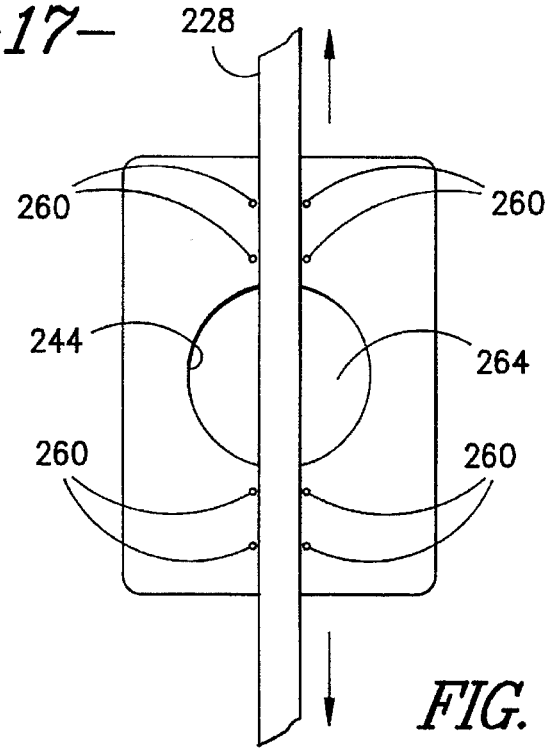
FIG. 19 is cross-sectional view taken along Line 17—17 of FIG. 17.

A second alternative of the embodiment is disclosed in FIGS. 17, 18, and 19. This includes base member 234 and a cover plate 242. The elongate, flexible member 228 is utilized as previously described and designated by numerals 28 and 128. There is a dimensionally alterable, electric element 264 which can apply direct force against the elongate, flexible member 228 when subjected to an electromagnetic field. There are a series of spacers 260 which are located between base member 234 and cover plate 242 to provide the dual purpose of attaching the base member 234 to cover plate 242 as well as providing a guide for the flexible elongate member 228. The number of spacers 260 may vary. An illustrative preferred embodiment would include four spacers 260 below and four spacers 260 above the dimensionally alterable, electric element 264. The dimensionally alterable, electric element 264 extends through an opening 244 in the cover plate 242 so that a portion of the dimensionally alterable, electric element 264 is supported by the cover plate 242. When the dimensionally alterable, electric element 264 is activated, direct force against the elongate, flexible member 228, which as previously described, allows the reciprocating beam 60 holding the force transfer element 62 in an upper position and thereby the rod eye 20 so that the warp yarn 8 forming the shed 37 is in he upper position, as shown in FIG. 1. When the dimensionally alterable, electric element 264 is not activated, the elongate, flexible member 228 can move back and forth unhindered. As previously described, this allows up and down movement of the rod eye 20 when the latch mechanism 26 is not holding the flexible elongate member 228 in place, as shown in FIG. 1. A typical nonlimiting example of a dimensionally alterable, electric element 264 is a piezo-electric element. A typical nonlimiting example of a piezo-electric element is Model No. C3900 manufactured by Aura Ceramics, Inc., located at 5121 Winnetka Avenue N., New Hope, Minn. 55428. An application of plus or minus three hundred volts is preferred. Another type of dimensionally alterable, electric element 264 is an electrostrictive device. An application of plus or minus 300 volts is preferred. A typical nonlimiting example of an electrostrictive device is Model No. PLZT 9.0-65/35 that is also manufactured by Aura Ceramics, Inc.

As this invention may be embodied in several forms without departing from the spirit or essential character thereof, the embodiments presented herein are intended to be illustrative and not descriptive. The scope of the invention is intended to be defined by the following appended claims, rather than any descriptive matter hereinabove, and all embodiments of the invention which fall within the meaning and range of equivalency of such claims are, therefore, intended to be embraced by such claims.

What is claimed is:

1. A jacquard loom latch mechanism comprising of a:

(a) a base member having a longitudinal axis and a guide;

(b) an elongate, flexible member that can be selectively moved up and down in a direction parallel to said longitudinal axis of said base member within said guide for raising and lowering operatively attached rod eyes; and (c) a mechanism for selectively latching said elongate, flexible member in a fixed position in relation to said base member that includes a means for applying a vacuum to said guide, whereby said latching mechanism is operatively attached to said base member.

2. A jacquard loom latch mechanism as defined in claim 1, wherein said guide is a curved channel.

3. A jacquard loom latch mechanism comprising of a:

(a) a base member having a longitudinal axis and a guide;

(b) an elongate, flexible member that can be selectively moved up and down in a direction parallel to said longitudinal axis of said base member within said guide for raising and lowering operatively attached rod eyes; and (c) a mechanism for selectively latching said elongate, flexible member in a fixed position in relation to said base member that includes a chamber within said base member connected to said guide, and means for applying gas under pressure to said chamber, a means for applying a vacuum to said chamber and a means for selectively preventing said gas under pressure from entering said chamber, whereby said latching mechanism is operatively attached to said base member.

4. A jacquard loom latch mechanism comprising of a:

(a) a base member having a longitudinal axis and a guide;

(b) an elongate, flexible member that can be selectively moved up and down in a direction parallel to said longitudinal axis of said base member within said guide for raising and lowering operatively attached rod eyes; and (c) a mechanism for selectively latching said elongate, flexible member in a fixed position in relation to said base member that includes a chamber within said base member, a conduit connecting said chamber to said guide, and means for applying gas under pressure to said chamber, a means for applying a vacuum to said conduit and a means for selectively preventing said gas under pressure from entering said conduit, whereby said latching mechanism is operatively attached to said base member.

5. A jacquard loom latch mechanism as defined in claim 4, wherein said means for selectively preventing gas under pressure from entering said conduit includes a piezo-electric element located within said chamber.

6. A jacquard loom latch mechanism as defined in claim 5, wherein said piezo-electric element includes a bimorph that can block an opening to said conduit.

7. A jacquard loom latch mechanism as defined in claim 4, wherein said means for applying a vacuum to said guide includes a groove parallel to longitudinal axis in said base member within said guide connected to said conduit.

8. A jacquard loom latch mechanism as defined in claim 4, wherein said means for applying a vacuum to said guide includes a plurality of grooves parallel to a longitudinal axis in said base member within said guide connected to said conduit.

9. A jacquard loom latch mechanism as defined in claim 4, wherein said means for applying a vacuum to said conduit includes a first tube and a means for attaching said first tube to said base member.

10. A jacquard loom latch mechanism as defined in claim 9, wherein said means for attaching said first tube to said base member includes a fitting adaptor.

11. A jacquard loom latch mechanism as defined in claim 4, wherein said means for applying gas under pressure to said chamber includes a second tube and a means for connecting said second tube to said chamber.

12. A jacquard loom latch mechanism as defined in claim 11, wherein said means for connecting said second tube to said chamber includes a capillary tube.

13. A jacquard loom latch mechanism comprising of a:

(a) a base member having a longitudinal axis and a guide;

(b) an elongate, flexible member that can be selectively moved up and down in a direction parallel to said longitudinal axis of said base member within said guide for raising and lowering operatively attached rod eyes; and (c) a mechanism for selectively latching said elongate, flexible member in a fixed position in relation to said base member that includes a chamber within said base member, a conduit connecting said chamber to said guide, and means for opening said chamber to atmosphere, a means for applying a vacuum to said conduit and a means for selectively preventing gas from entering said conduit from said chamber, whereby said latching mechanism is operatively attached to said base member.

14. A jacquard loom latch mechanism as defined in claim 13, wherein said means for selectively preventing gas from entering said conduit includes a piezo-electric element located within said chamber.

15. A jacquard loom latch mechanism as defined in claim 14, wherein said piezo-electric element includes a bimorph that can block an opening to said conduit.

16. A jacquard loom latch mechanism as defined in claim 13, wherein said means for applying a vacuum to said guide includes a groove parallel to longitudinal axis in said base member within said guide connected to said conduit.

17. A jacquard loom latch mechanism as defined in claim 13, wherein said means for applying a vacuum to said guide includes a plurality of grooves parallel to a longitudinal axis in said base member within said guide connected to said conduit.

18. A jacquard loom latch mechanism as defined in claim 13, wherein said means for applying a vacuum to said conduit includes a first tube and a means for attaching said first tube to said base member.

19. A jacquard loom latch mechanism as defined in claim 18, wherein said means for attaching said first tube to said base member includes a fitting adaptor.

20. A jacquard loom latch mechanism as defined in claim 13, wherein said means for opening said chamber to atmosphere includes a second tube and a means for connecting said second tube to said chamber.

21. A jacquard loom latch mechanism as defined in claim 20, wherein said means for connecting said second tube to said chamber includes a capillary tube.

22. A jacquard loom latch mechanism comprising of a:

(a) a base member having a longitudinal axis and a guide;

(b) an elongate, flexible member that can be selectively moved up and down in a direction parallel to said longitudinal axis of said base member within said guide for raising and lowering operatively attached rod eyes; and (c) a mechanism for selectively latching said elongate, flexible member in a fixed position in relation to said base member that includes a top plate attached to said base member thereby forming a chamber, a conduit connecting said chamber to said guide, and a means for applying gas under pressure to said chamber, a means for applying a vacuum to said conduit and a means for selectively preventing said gas under pressure from entering said conduit, whereby said latching mechanism is operatively attached to said base member.

23. A jacquard loom latch mechanism as defined in claim 22, wherein said means for selectively preventing said gas under pressure from entering said conduit includes a piezo-electric element.

24. A jacquard loom latch mechanism comprising of a:

(a) a base member having a longitudinal axis and a guide;

(b) An elongate, flexible member that can be selectively moved up and down in a direction parallel to said longitudinal axis of said base member within said guide for raising and lowering operatively attached rod eyes; and (c) a mechanism for selectively latching said elongate, flexible member in a fixed position in relation to said base member that includes a top plate attached to said base member thereby forming a chamber, a conduit connecting said chamber to said guide, and a means for opening said chamber to atmosphere, a means for applying a vacuum to said conduit and a means for selectively preventing gas from entering said conduit from said chamber, whereby said latching mechanism is operatively attached to said base member.

25. A jacquard loom latch mechanism as defined in claim 24, wherein said means for selectively preventing gas under pressure from entering said conduit includes a piezo-electric element.

26. A jacquard loom latch mechanism as defined in claim 25, wherein said guide is a rectangular chamber.

27. A jacquard loom latch mechanism comprising of:

(a) a base member having a longitudinal axis and a guide;

(b) an elongate, flexible member that can be selectively moved up and down in a direction parallel to said longitudinal axis of said base member within said guide for raising and lowering operatively attached rod eyes; and (c) a mechanism for selectively latching said elongate, flexible member in a fixed position in relation to said base member that includes a sealed elastomeric, elongate member within said guide and a means for applying pressurized gas to said sealed elastomeric, elongate member for selectively latching said elongate, flexible member in a fixed position, whereby said latching mechanism is operatively attached to said base member.

28. A jacquard loom latch mechanism as defined in claim 27, further comprising a top member attached to said base member forming a rectangular chamber therebetween.

29. A jacquard loom latch mechanism comprising of a:

(a) a base member having a longitudinal axis and a guide;

(b) an elongate, flexible member that can be selectively moved up and down in a direction parallel to said longitudinal axis of said base member within said guide for raising and lowering operatively attached rod eyes;

(c) a mechanism for selectively latching said elongate, flexible member in a fixed position in relation to said base member wherein said base member includes a sealed elastomeric, elongate member within said guide and a means for applying pressurized gas to said sealed elastomeric, elongate member for selectively latching said elongate, flexible member in a fixed position includes a first tube and a means for attaching said first tube to said base member, whereby said latching mechanism is operatively attached to said base member; and (d) a top member attached to said base member forming a rectangular chamber therebetween.

30. A jacquard loom latch mechanism as defined in claim 29, wherein said means for connecting said first tube to said top member includes a capillary tube.

31. A jacquard loom latch mechanism comprising of a:

(a) a base member having a longitudinal axis and a guide;

(b) an elongate, flexible member that can be selectively moved up and down in a direction parallel to said longitudinal axis of said base member within said guide for raising and lowering operatively attached rod eyes; and (c) a mechanism for selectively latching said elongate, flexible member in a fixed position in relation to said base member that within said guide includes a dimensionally alterable, electric element attached to a top member mounted in spaced relationship to said base member for selectively latching said elongate, flexible member in a fixed position by applying direct force against said elongate, flexible member, whereby said latching mechanism is operatively attached to said base member.

32. A process for latching a jacquard loom rod comprising the steps of:

(a) utilizing an elongate, flexible member that can be selectively moved up and down in a direction parallel to a longitudinal axis of a base member within a guide for raising and lowering operatively attached rod eyes; and (b) applying a vacuum to said elongate, flexible member to selectively latch said elongate, flexible member in a fixed position.

33. A process for latching a jacquard loom rod comprising the steps of:

(a) utilizing an elongate, flexible member that can be selectively moved up and down in a direction parallel to a longitudinal axis of a base member and adjacent thereto in a guide for raising and lowering operatively attached rod eyes; and (b) applying pressurized gas to a sealed elastomeric, elongate member to selectively latch said elongate, flexible member in a fixed position.

34. A process for latching a jacquard loom rod comprising the steps of:

(a) utilizing an elongate, flexible member that can be selectively moved up and down in a direction parallel to a longitudinal axis of a base member and adjacent thereto within a guide for raising and lowering operatively attached rod eyes; and (b) applying pressure from a dimensionally alterable, electric element to said elongate, flexible member to selectively latch said resilient member in a fixed position.

35. A process for latching a jacquard loom rod comprising the steps of:

(a) utilizing an elongate, flexible member that can be selectively moved up and down in a direction parallel to a longitudinal axis of a base member within a guide for raising and lowering operatively attached rod eyes;

(b) applying pressurized gas to a chamber that is in fluid relationship with said guide;

(c) selectively preventing said pressurized gas from entering said chamber by means of a piezo-electric element; and (d) applying a vacuum to said chamber and said guide thereby selectively latching said elongate, flexible member in a fixed position when pressurized gas is prevented from entering said chamber.

36. A process for latching a jacquard loom rod comprising the steps of:

(a) utilizing an elongate, flexible member that can be selectively moved up and down in a direction parallel to a longitudinal axis of a base member within a guide for raising and lowering operatively attached rod eyes;

(b) applying pressurized gas to a chamber that is connected to said guide by a conduit;

(c) selectively preventing said pressurized gas from entering said conduit by means of a piezo-electric element; and (d) applying a vacuum to said conduit thereby selectively latching said elongate, flexible member in a fixed position within said guide whe pressurized gas is prevented from entering said conduit.

* * * * *